United States Patent [19]

Baumann

[11] Patent Number: 4,516,979

[45] Date of Patent: May 14, 1985

[54] POLYBENZOATES AS DISPERSE DYEING ASSISTANTS

[75] Inventor: Hans-Peter Baumann, Ettingen, Switzerland

[73] Assignee: Sandoz Ltd., Basel, Switzerland

[21] Appl. No.: 452,230

[22] Filed: Dec. 23, 1982

[30] Foreign Application Priority Data

Dec. 24, 1981 [DE] Fed. Rep. of Germany ..... 3151433
Jan. 2, 1982 [DE] Fed. Rep. of Germany ..... 3200003

[51] Int. Cl.[3] ..... D06P 1/65; C09B 1/60

[52] U.S. Cl. ..... 8/583; 8/609; 8/922

[58] Field of Search ..... 8/583, 609

[56] References Cited

U.S. PATENT DOCUMENTS

| | | | |
|---|---|---|---|
| 2,362,376 | 11/1944 | Heymann | 8/583 |
| 2,901,311 | 8/1959 | Nusslein et al. | 8/445 |
| 4,060,387 | 11/1977 | Baumann et al. | 8/582 |
| 4,072,465 | 2/1978 | Daeuble | 8/582 |
| 4,286,960 | 9/1981 | Schneider et al. | 8/527 |
| 4,333,732 | 6/1982 | Deubel et al. | 8/527 |
| 4,369,270 | 1/1983 | Dietz et al. | 524/33 |

FOREIGN PATENT DOCUMENTS

| | | |
|---|---|---|
| 53-74181 | 7/1978 | Japan . |
| 1491935 | 11/1977 | United Kingdom . |

OTHER PUBLICATIONS

Abstract (English) and claims (German) of Japanese Patent Application No. 52-140677.

Abstract and claim (in English) of Japanese Patent Application No. 55-122086.

Abstract and claims (in English) of Japanese Patent Application No. 55-22039.

Abstract (English) of Japanese Patent Application No. 51-88780.

*Primary Examiner*—A. Lionel Clingman

*Attorney, Agent, or Firm*—Gerald D. Sharkin; Richard E. Vila; Thomas C. Doyle

[57] ABSTRACT

The invention relates to a method of dyeing or printing a textile substrate with disperse dyes, using as a dyeing assistant the product of polyesterifying an aliphatic polyol or etherpolyol or a disaccharide with benzoic acid or substituted benzoic acid.

20 Claims, No Drawings

POLYBENZOATES AS DISPERSE DYEING ASSISTANTS

The present invention relates to dyeing assistants for dyeing with disperse dyestuffs.

The invention provides a method of dyeing or printing a textile substrate with disperse dyes which comprises using as a dyeing assistant the product of polyesterifying an aliphatic polyol or etherpolyol or a disaccharide with benzoic acid or benzoic acid substituted on the phenyl ring by up to three substituents selected from chlorine, $C_{1-4}$alkyl and $C_{1-4}$alkoxy.

Preferably the dyeing assistant of the invention is a compound obtained by full esterification of the polyfunctional alcohol. However, when a polyfunctional alcohol containing more than two hydroxy groups is used, the dyeing assistant may also be a partially esterified compound wherein more than an average value of 50% of the hydroxy groups are esterified.

Preferred dyeing assistants are the polyesterified compounds obtained from an aliphatic $C_{2-8}$diol, e.g. ethylene glycol, 1,2- or 1,3-propanediol, butanediols, pentanediols or hexanediols, an aliphatic $C_{3-6}$ triol e.g. glycerol, and other aliphatic polyols such as pentaerythritol, glucose and the like, an aliphatic ether-polyol e.g. a polyfunctional alcohol containing at least one ether group, preferably an ether-diol such as a compound of formula I:

$$HO—C_qH_{2q}—O—C_rH_{2r})OH \qquad \text{I}$$

wherein q and r, independently, are 2,3 or 4 or a disaccharide such as sucrose.

Preferred ether-diols of formula I are diethylene glycol and dipropylene glycol.

The benzoic moiety present in the polyesterified compounds used as dyeing assistant is preferably either unsubstituted or monosubstituted on the phenyl ring by chlorine, methyl or methoxy.

Particularly preferred dyeing assistants are diesters produced from aliphatic diols or ether-diols with benzoic acid or monosubstituted benzoic acid, more preferably the ethylene glycol, 1,2- or 1,3-propanediol, diethylene glycol or dipropylene glycol dibenzoates.

The dyeing assistants of the invention are either known or may be prepared in accordance with known methods. Preferably they are produced by transesterification of a benzoic acid ester optionally substituted on the phenyl ring as indicated above, conveniently a $C_{1-4}$alkyl ester, especially the methyl ester. Preferably the transesterification is carried out with a slight excess of the polyfunctional alcohol, e.g. 1.1 mols diol with 2 mols benzoate.

Depending on the reaction conditions, the dyeing assistant may be prepared, separated and purified as a pure compound; it may also be obtained and used as a mixture of polyesterified polyols which may further contain as by-products monoesters of diols or ether-diols or partially esterified polyols where less than 50% of the hydroxy groups are esterified, and even small amounts of unesterified starting materials. The by-products do not adversely affect the dyeing assistant properties of the polyesterified polyols.

The dyeing assistants are useful for printing and dyeing (including padding), particularly exhaust dyeing under either normal or high pressure, at a temperature up to 140° C. They cause a rapid penetration of the dyestuffs into the substrate. Furthermore they promote the migration of the dyestuffs and hence have a strong levelling action. The levelness of the dyeings, even on striped substrates having different affinity is excellent. The dyeing assistants of the invention are virtually odourless and practically non-volatile. They do not affect the fastness properties of the disperse dyestuffs, and furthermore they are biodegradable.

Suitable textile substrates are those consisting of or comprising synthetic or semi-synthetic hydrophobic, high molecular weight organic textile materials, e.g. polyester, cellulose triacetate, cellulose $2\frac{1}{2}$ acetate and synthetic polyamides, especially linear, aromatic polyester.

The dyeing assistants are particularly effective in rapid dyeing of polyester fibres, i.e. a process where the dyeing time is significantly shorter than in the conventional polyester dyeing processes. For example, rapid dyeing may be carried out for only 20 minutes at 130° C., the degree of adsorption of the disperse dyes being after this short dyeing time $\geqq 95\%$.

Dyeing, padding and printing using a dyeing assistant according to this invention may be carried out in accordance with known methods. The dyeing assistant is generally added to the dyebath, in an amount from 0.5 to 30 g/l, preferably 1 to 5 g/l; it is added to the padding liquors and printing pastes in an amount from 0.5 to 3 times the amount of the disperse dyestuffs used.

The dyeing assistants having a low water-solubility, it is preferred to add the dyeing assistant to the dyebath, padding liquor or printing paste together with an emulsifying agent as an aqueous emulsion. Non-ionic, cationic, amphoteric or anionic emulsifying agents or mixtures thereof can be used, e.g. $C_{1-4}$ alkyl $C_{14-18}$ fatty acid esters such as a $C_{1-4}$alkyl oleic acid ester, condensation products of ethylene oxide with castor oil or $C_{4-15}$ alkylphenols such as castor oil ethoxylated with 5 to 50 mols ethylene oxide, preferably 15 to 40 mols, or a $C_{4-15}$alkylphenol polyglycol ether containing from 5 to 40 ethyleneoxy units, sodium alkylarylsulphonates such as sodium alkylbenzene sulphonate and the like. The alkylphenol polyglycol derivatives may further be at least partially carboxymethylated. Anionic emulsifying agents are preferred.

Particularly preferred emulsifying agents are the compounds of formula II:

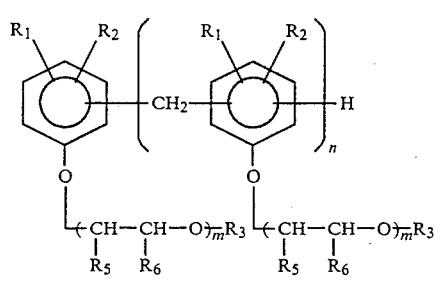

II wherein each $R_1$, independently, is $C_{4-14}$alkyl, each $R_2$, independently, is H or $C_{1-10}$alkyl, with the proviso that the sum of the carbon atoms present in $R_1$ and $R_2$ borne by the same phenyl ring is from 6 to 18, 0.5 to n of the $R_3$'s are $—SO_3R_4$, $—CH_2CO_2R_4$ or $$O{=}\overset{|}{P}(OH)_2,$$

the remaining $R_3$'s being H, each $R_4$, independently, is H, an alkali metal, an equivalent of an alkali metal, ammonium, ammonium substituted by up to four $C_{1-4}$alkyl or up to three $C_{2-4}\beta$-, $\gamma$- or $\delta$-hydroxyalkyl, or a cycloimmonium group, $R_5$ and $R_6$ are both H, with the proviso that in, on average, up to 60% of the units —$CHR_5CHR_6$— one of the groups $R_5$ or $R_6$ may be methyl, each m, independently, is an integer from 4 to 20, and n is an integer from 1 to 9.

Preferred emulsifying agents of formula II are those having one or more of the following significances:

(i) each $R_1$, independently, is n-$C_{6-12}$alkyl, preferably in the p-position to —O—$CHR_5$—$(CHR_6)_m$, (ii) each $R_2$, independently, is H or $C_{1-6}$alkyl, (iii) 0.5 to (n/2) $R_3$'s are —$SO_3R_4$ or —$CH_2CO_2R_4$, preferably 1 to (n/2), $R_3$'s, the remaining $R_3$'s being H, (iv) each $R_4$, independently, is H, ammonium, sodium, potassium or a magnesium or calcium equivalent (v) in all the units —$CHR_5$—$CHR_6$—, $R_5$ and $R_6$ are H or on average in up to 40% of the units one of $R_5$ and $R_6$ is H and the other is methyl, in the remaining units $R_5$ and $R_6$ being H, (vi) each m, independently, is an integer from 6 to 15, (vii) n is an integer from 1 to 6.

The compounds of formula II may be prepared according to known methods, e.g. as disclosed in GB No. 1,425,391.

The emulsifying agents are suitably added to the dyeing assistant of the invention in amounts, generally ranging from 5 to 30, preferably from 15 to 25% by weight based on the weight of dyeing assistant of the invention.

When a mixture of emulsifying agents is used, such preferably contains compounds selected from one or more compounds of formula II, a $C_{1-4}$alkyl $C_{14-18}$ fatty acid ester, e.g. a $C_{1-4}$alkyl oleate, an at least partially carboxymethylated $C_{4-15}$alkylphenol polyglycol ether, preferably such a derivative ethoxylated with 5 to 40 mols ethylene oxide, castor oil ethoxylated with 5 to 50 mols ethylene oxide and sodium $C_{5-15}$alkylbenzene sulphonate.

The dyeing assistant of the invention may advantageously be used in form of a composition comprising, in addition to the emulsifying agents, further ingredients such as a dispersing agent e.g. lignin sulphonates, sulphonated succinates, sodium dinaphthylmethanedisulphonate and others which are already incorporated in the commercially available dyeing preparations, a carrier e.g. diphenyl, diphenylether, ditolylether, methylnaphthalene, o- or p-phenylphenol, cyclohexylphenol, dibenzofuran, benzyl benzoate and $C_{4-12}$alkyl benzoates, a carrier having simultaneously emulsifying properties e.g. $C_{1-6}$alkyl esters of aliphatic $C_{3-6}$dicarboxylic acids especially di-n-butyl malonate, succinate or adipate, and in the case of printing pastes also a thickening agent. Such compositions also form part of the invention.

The composition of the invention may contain further auxiliaries for improving the homogeneity of the mixture, e.g. oleic acid, and, if desired, an anti-foaming agent such as paraffin oil. As already indicated, the dyeing assistant may contain small amounts of the corresponding monoester or partially esterified polyol as by-products. However, it may be advantageous to increase the amount of the monoester and to add to the composition a further monoester of an aliphatic polyol or ether-polyol such as specified, preferably a monoester of an aliphatic $C_{2-8}$diol, especially ethylene glycol or 1,2- or 1,3-propylene glycol monobenzoate. The weight ratio of the polyesterified compound to the benzoic acid monoester is 0.5–17:1, preferably 0.8–4:1.

Preferred compositions are those comprising:

15 to 85 parts by weight of a dyeing assistant of the invention or a mixture thereof, 15 to 40 parts by weight of one or more emulsifying agents, preferably one or more compounds of formula II optionally in admixture with further emulsifying agents such as specified above, 0 to 20 parts by weight of a polyol or ether-polyol, preferably an aliphatic $C_{2-8}$ diol, monoesterified with benzoic acid or benzoic acid substituted on the phenyl ring by up to three substituents selected from chlorine, $C_{1-4}$alkyl and $C_{1-4}$alkoxy, 0 to 20 parts by weight of a carrier selected from diphenyl, diphenylether, ditolylether, methylnaphthalene, o- or p-phenylphenol, cyclohexylphenol, dibenzofuran, benzyl benzoate and $C_{4-12}$alkyl benzoate or a mixture thereof, 0 to 5 parts by weight of a mono-, di- or tri-$C_{2-4}$alkylamine or a mono-, di- or tri-$C_{2-4}$-$\beta$-, $\gamma$- or $\delta$-alkanolamine when the emulsifying agent or mixture comprises a compound of formula II as stated above, and paraffin oil in an amount up to 5% by weight of the amount of dyeing assistant.

Further examples of preferred compositions are the following comprising:

either 25 to 50 parts by weight of a dyeing assistant of the invention or a mixture thereof, 20 to 40 parts by weight of one or more methyl $C_{14-18}$ fatty acid esters or of a mixture of methyl oleate and benzyl benzoate in the ratio 2:1 and 10 to 35 parts by weight of an at least partially carboxymethylated condensate of a $C_{4-15}$alkylphenol with 5 to 40 mols ethylene oxide, preferably a fully carboxymethylated polyglycol ether, or 50 to 70 parts by weight diethyleneglycol dibenzoate, 15 to 25 parts by weight of a compound of formula II obtained by reacting 7 mols nonylphenol with 6 mols formaldehyde, 50 mols ethylene oxide and 1 mol amidosulphonic acid, 15 to 25 parts by weight methyl oleate, and 2 to 3 parts by weight triisopropanolamine, or 5 to 15 parts by weight ethyleneglycol dibenzoate, 7 to 20 parts by weight 1,2-propyleneglycol dibenzoate, 15 to 25 parts by weight of a compound of formula II obtained by reacting 7 mols nonylphenol with 6 mols formaldehyde, 50 mols ethylene oxide and 1 mol amidosulphonic acid, 10 parts by weight diphenyl, 3 to 10 parts by weight ethylene glycol monobenzoate, 5 to 15 parts by weight 1,2-propyleneglycol monobenzoate, 25 to 35 parts by weight oleic acid, and 1.5 to 3 parts by weight triisopropanolamine, or a dyeing assistant of the invention and 5 to 30% by weight, preferably 15 to 25% by weight, based on the weight of dyeing assistant, of one or more emulsifying agents, e.g. castor oil ethoxylated with 5 to 50 mols ethylene oxide or sodium $C_{5-15}$alkylbenzene sulphonate.

Depending on the ingredients they contain, the compositions of the invention may be either in solid, liquid or paste form, Preferably they are used as an aqueous emulsion or a solution in a solvent, e.g. a lower alcohol such as ethanol, isopropanol or the like.

The compositions of the invention may be prepared by known methods, e.g. by mixing with a stirrer at room temperature.

The following Examples further serve to illustrate the invention. In the Examples all parts and percentages are by weight and all temperatures in degrees Centigrade.

(a) Benzoic acid esters

The esters indicated in the following Table (a) are produced by transesterification of methyl benzoate with the corresponding di- or polyol. The product numbered 1 to 13 are mixtures obtained from the reaction of 2 mols methyl benzoate. The compounds 14 to 18 are pure esters.

TABLE (a)

| No. | Esters | |
|---|---|---|
| 1 | Transesterification with | 1.1 mols ethylene glycol |
| 2 | Transesterification with | 1.2 mols 1,3-propanediol |
| 3 | Transesterification with | 1.2 mols 1,2-propanediol |
| 4 | Transesterification with | 1.2 mols 1,4-butanediol |
| 5 | Transesterification with | 1.2 mols 1,3-butanediol |
| 6 | Transesterification with | 1.2 mols diethylene glycol |
| 7 | Transesterification with and | 0.5 mols ethylene glycol 0.6 mols 1,2-propanediol |
| 8 | Transesterification with and | 0.5 mols ethylene glycol 0.6 mols 1,4-butanediol |
| 9 | Transesterification with | 0.35 mols ethylene glycol 0.35 mols 1,3-propanediol and 0.35 mols 1,4-butanediol |
| 10 | Transesterification with | 1.2 mols hexylene glycol |
| 11 | Transesterification with | 0.93 mols glycerol |
| 12 | Transesterification with | 1.2 mols neopentyl glycol |
| 13 | a sucrose benzoate mixture of the general formula $[C_{12}H_{14}O_3(OH)_{0.9}(O—CO—C_6H_5)_{7.1}]$ | |
| 14 | diethylene glycol dibenzoate | |
| 15 | dipropylene glycol dibenzoate | |
| 16 | glyceryl tribenzoate | |
| 17 | neopentylglycol dibenzoate | |
| 18 | pentaerythritol tetrabenzoate. | |

(b) Emulsifying agents of formula II

They are prepared according to GB No. 1,425,391.

In the compounds 1 to 17, 20, 21 and 22 indicated in the following Table (b) $R_1$ is nonyl, in the compound 18 $R_1$ is dodecyl and in each of these compounds $R_2$ is hydrogen.

Compound 19 is produced from 1.5 mols nonylphenol and 1.5 mols p-cresol.

The amount of formaldehyde mols used for the production of the compounds of formula I of the Table (b) is 1 unit less than the number of phenol mols.

TABLE (b)

| Compound | Phenol mols | Ethylene oxide mols | Propylene oxide mols | Amidosulphonic acid/mols |
|---|---|---|---|---|
| 1 | 9 | 60 | — | 1 |
| 2 | 9 | 180 | — | 3 |
| 3 | 9 | 140 | 20 | 3 |
| 4 | 9 | 120 | — | 2.5 |
| 5 | 7 | 100 | — | 3 |
| 6 | 7 | 50 | — | 1 |
| 7 | 7 | 40 | 10 | 1.5 |

TABLE (b)-continued

| | | | | |
|---|---|---|---|---|
| 8 | 7 | 75 | — | 1 |
| 9 | 5 | 20 | — | 1.5 |
| 10 | 5 | 100 | — | 2.5 |
| 11 | 3 | 20 | — | 1 |
| 12 | 3 | 20 | — | 0.5 |
| 13 | 3 | 20 | 20 | 1.5 |
| 14 | 2 | 20 | — | 1 |
| 15 | 3 | — | — | 2 |
| 16 | 2 | 8 | — | 1.25 |
| 17 | 2 | 40 | — | 1 |
| 18 | 3 | 60 | — | 1.5 |
| 19 | 1.5 nonylphenol + 1.5 p-cresol | 60 | — | 0.75 |

| Compound | Phenol mols | Ethylene oxide mols | Propylene oxide mols | Sodium monochloroacetate/mols |
|---|---|---|---|---|
| 20 | 9 | 120 | — | 3 |
| 21 | 7 | 50 | — | 1.5 |
| 22 | 7 | 50 | — | 0.5 $P_2O_5$ |

EXAMPLE 1

5 Parts scoured polyester are introduced at 70° in a HT-dyeing machine in 100 parts of a dyebath containing:

0.1 part of the commercially available dye C.I. Disperse Blue 148 (containing a dispersing agent), 0.35 part of mixture 1 of Table (a) mixed with 10% ethoxylated castor oil and 10% sodium dodecylbenzenesulphonate, and 2.0 parts ammonium sulphate, and adjusted to pH 5 with formic acid.

After the dyeing machine has been closed, the temperature of the dyebath is raised to 130° over 20 minutes and maintained at 130° for 20 minutes. After cooling, the substrate is taken out, rinsed, soaped, rinsed again and dried.

The substrate is evenly dyed in a deep blue shade with very good fastness. The dyebath is completely exhausted; a sample of the dyebath taken immediately after the temperature of the dyebath has reached 130° is already exhausted to about 95%.

Analogous results are obtained when the dyeing is carried out in the presence of any one of the dyeing assistant of Table (a).

EXAMPLE 2

10 Parts polyester fabric (Dacron ®T54, Du Pont) are introduced at 60° in a dyeing autoclave in 400 parts of a dyebath containing:

0.05 part of the commercially available C.I. Disperse Red 73, 0.7 part of mixture 7 of Table (a) mixed with 10% ethoxylated castor oil and 10% sodium dodecylbenzenesulphonate, and 3.0 parts ammonium sulphate, and adjusted to pH 5 with formic acid.

The temperature is then raised to 130° over 30 minutes and dyeing is carried out at 130° for 30 minutes. After cooling, the dyed substrate is taken out, rinsed, soaped, rinsed again and dried.

A ruby red dyeing having excellent fastness properties and a perfect levelness is thus obtained.

Analogous good results are achieved when the mixture 7 is replaced by any one of the mixtures of Table (a) or by a compound 16, 17 or 18 or when C.I. Disperse Red 73 is replaced by C.I. Disperse Blue 183.

The results are similarly good when a polyester fabric which tends to give striped dyeings is used instead of polyester Dacron ®T54.

EXAMPLE 3

By following the procedure of Example 1 but replacing 0.35 parts of the mixture 1 of Table (a) mixed with 10% ethoxylated castor oil and 10% sodium dodecylbenzene-sulphonate by 0.32 parts of the mixture 1 of Table (a) together with 0.08 parts of compound 5 of Table (b) the same good results are obtained.

Dyeings with similar good properties are achieved when using any one of the dyeing assistant of Table (a) in admixture with a compound of Table (b).

EXAMPLE 4

By repeating the procedure of Example 2 but replacing the 0.7 parts of mixture 7 of Table (a) mixed with ethoxylated castor oil and sodium dodecylbenzene-sulphonate by 0.5 parts of mixture 1 of Table (a) in admixture with 0.15 parts of compound 6 in Table (b) and 0.035 parts diphenyl, similar good results are obtained.

Dyeings with similar good properties are obtained when using any one of the dyeing assistant of Table (a) in admixture with a compound of Table (b).

EXAMPLE 5

100 Parts polyester fabrics which tend to give striped dyeings are introduced at 40° in 4000 parts of a dyebath containing:

0.2 parts of C.I. Disperse Blue 73,
9.0 parts of the mixture 2 of Table (a),
2.0 parts of the compound 11 of Table (b),
0.8 parts diphenyl,
0.02 parts paraffin oil, and
8 parts ammonium sulphate,
and adjusted to pH 5 with formic acid.

The dyebath is then heated to 97° over 30 minutes and dyeing is carried out for 1 hour at this temperature. The dyed substrate is then washed, rinsed and dried. An even blue dyeing with very good fastness properties is obtained.

By following the same procedure but replacing the dyeing assistant and auxiliaries by the following ingredients:

6.0 parts of the mixture 4 of Table (a),
2.4 parts of the compound 20 of Table (b) or any other compound of Table (b),
0.6 parts diphenyl,
0.6 parts paraffin oil, and
2.4 parts n-butanol,
similar good dyeing results are obtained.

EXAMPLE 6

A polyester ribbon (diolene-satin) consisting of unstretched (1:3.2) and normally stretched (1:3.66) yarn is introduced in a dyebath at 60° at a liquor to goods ratio of 40:1. The dyebath contains per 1.000 parts 3.2% (based on the weight of the substrate) of C.I. Disperse Blue 87

2 parts ammonium sulphate,
4 parts citric acid, and
4 parts of a mixture containing 50% pure diethylene glycol dibenzoate (compound 14 of Table (a), 20% of the compound 4 of Table (b), 10% ditolyl ether as a technical isomer mixture, 5% paraffin oil and 5% condensate of castor oil with 32 mols ethylene oxide.

The temperature of the dyebath is then raised to 130° over 45 minutes. The substrate is dyed at this temperature for 30 minutes and then cooled, rinsed and dried. A turquoise-blue dyeing with a perfect levelness is obtained.

Similar good dyeing results are obtained when using, as dyeing assistant, a mixture comprising 60% of the ester mixture 9 of Table (a), 20% of the compound 6 of Table (b), 10% ethyl-hexanol, 3% diphenyl and 2% paraffin oil, or a mixture comprising 80% of a mixture as indicated in Table (a) and 20% of the compound 12 of Table (b).

EXAMPLE 7

100 Parts polyester fabric are dyed at 130° for 45 minutes in an autoclave in 1000 parts of a dyebath containing:

1.48 parts of a commercially available navy blue disperse dye mixture (e.g. "Dispersol Navy CMD ®", ICI),
0.185 parts C.I. Disperse Orange 76,
0.04 parts C.I. Disperse Yellow 54,
0.035 parts C.I. Disperse Blue 87,
4.0 parts polyoxyalkylene terephthalate as disclosed in GB Patent Specification Nos. 1,088,984 and 1,175,207 and
20.0 parts of a dyeing assistant mixture containing 38.5% diethyleneglycol dibenzoate, 28.0% methyl $C_{14-18}$ fatty acid ester (mixture), 4.8% oleic acid, 9.5% condensate of 10 mols ethylene oxide with 1 mol nonylphenol, 9.5% condensate of 10 mols ethylene oxide with 1 mol castor oil, 1.9% ethanolamine and 7.8% demineralized water,
which dyebath has been adjusted to pH 5 with acetic acid.

The dyed substrate is then rinsed and dried at 180°-200°. A deep navy blue dyeing with excellent levelness is thus obtained.

EXAMPLE 8

100 Parts polyester fabric are introduced in 900 parts of a dyebath containing 1.835 parts of the navy blue disperse dye mixture of Example 7 and 3 parts of the mixture of Example 7, and adjusted to pH 5 with acetic acid. Dyeing and afterdyeing are carried out according to the procedure of Example 7 with the same good results.

EXAMPLE 9

The procedures of Example 7 or 8 are repeated but replacing the disperse dye mixture by either 2 parts C.I. Disperse Red 73, or 2 parts C.I. Disperse Blue 79 or 2 parts C.I. Disperse Blue 183. There is obtained a rubin red, deep blue or navy blue dyeing, respectively.

EXAMPLE 10

The procedure of Example 7 is repeated but using as dyeing assistant a mixture containing 65.0% diethyleneglycol dibenzoate, 19.5% carboxymethylated condensate of 20 mols ethylene oxide with 1 mol nonylphenol, 10% methyl oleate and 5.5% benzyl benzoate instead of the dyeing assistant mixture of Example 7. Good results are thus obtained.

In the mixture above, the 65% diethyleneglycol dibenzoate can be replaced by the same amount of dipropylene glycol dibenzoate.

What is claimed is:

1. A composition comprising an aqueous emulsion of a compound of formula III $$X\text{-}(OX_1)_p \qquad \text{III}$$

wherein

X is a divalent $C_{2-8}$ saturated aliphatic hydrocarbon radical, a trivalent $C_{3-6}$ saturated aliphatic hydrocarbon radical, a pentavalent residue of glucose less its hydroxyl groups, a polyvalent residue of a disaccharide less its hydroxyl groups, or a divalent radical of the formula $-(C_qH_{2q}-O-C_rH_{2r})-$ wherein q and r are independently 2, 3, or 4, each $X_1$, independently, is hydrogen or a radical of formula IV

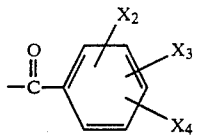

IV in which $X_2$, $X_3$ and $X_4$ are the same or different and are hydrogen, chloro, $C_{1-4}$alkyl or $C_{1-4}$alkoxy and p is a whole number equal to the valence of X, with the proviso that when p is 2 both $X_1$'s are radicals of formula IV and when p is greater than 2 more than an average value of 50% of the $X_1$'s are radicals of formula IV, and 5 to 30%, based on the weight of said compound, of an anionic emulsifying agent.

2. A composition according to claim 1 wherein, in the compound of formula III, each $X_1$ is a radical of formula IV.

3. A composition according to claim 1 wherein, in the compound of formula III, two of $X_2$, $X_3$ and $X_4$ are hydrogen and the other is hydrogen, chloro, methyl or methoxy.

4. A composition according to claim 1 wherein the compound of formula III is selected from the group consisting of ethylene glycol dibenzoate, 1,2- and 1,3-propanediol dibenzoates, diethylene glycol dibenzoate, dipropylene glycol dibenzoate and mixtures thereof.

5. A composition according to claim 1 wherein the compound of formula III is diethylene glycol dibenzoate.

6. A composition according to claim 1 wherein the compound of formula III is a diester produced by reacting an aliphatic diol or aliphatic ether diol with benzoic acid or monosubstituted benzoic acid.

7. A composition according to claim 1 wherein the emulsifying agent is a compound of formula II

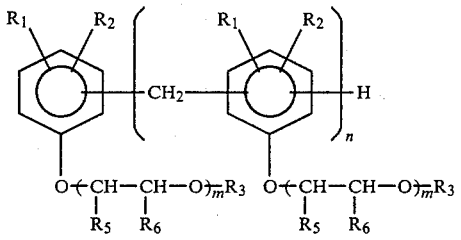

II wherein each $R_1$, independently, is $C_{4-14}$alkyl, each $R_2$, independently, is H or $C_{1-10}$alkyl, with the proviso that the sum of the carbon atoms present in $R_1$ and $R_2$ borne by the same phenyl ring is from 6 to 18, each $R_3$ is hydrogen, $-SO_3R_4$, $-CH_2CO_2R_4$ or $$O{=}\overset{|}{P}(OH)_2,$$

with the proviso that 0.5 to n of the $R_3$'s are $-SO_3R_4$, $-CH_2CO_2R_4$ or $$O{=}\overset{|}{P}(OH)_2,$$

each $R_4$, independently, is H, an alkali metal, an equivalent of an alkali earth metal, ammonium, ammonium substituted by up to four $C_{1-4}$alkyl or up to three $C_{2-4}\beta$-, $\gamma$- or $\delta$-hydroxyalkyl, or a cycloimmonium group either $R_5$ and $R_6$ are both H, or in, on average, up to 60% of the units $-CHR_5CHR_6-$ one of the groups of $R_5$ or $R_6$ is methyl and the other is hydrogen and in the remaining groups $-CHR_5CHR_6-$ both of $R_5$ and $R_6$ are hydrogen, each m, independently, is an integer from 4 to 20, and n is an integer from 1 to 9.

8. A composition according to claim 7 wherein, in the compound of formula III, each $X_1$ is a radical of formul IV.

9. A composition according to claim 8 wherein, in the compound of formula III, two of $X_2$, $X_3$ and $X_4$ are hydrogen and the other is hydrogen, chloro, methyl or methoxy.

10. A composition according to claim 7 wherein the compound of formula III is selected from the group consisting of ethylene glycol dibenzoate, 1,2- and 1,3-propylene glycol dibenzoates, diethylene glycol dibenzoate, dipropylene glycol dibenzoate and mixtures thereof.

11. A composition according to claim 10 comprising 50 to 70 parts by weight diethyleneglycol dibenzoate 15 to 25 parts by weight of a compound of formula II obtained by reacting 7 mols nonylphenol with 6 mols formaldehyde, 50 mols ethylene oxide and 1 mol amidosulphonic acid 15 to 25 parts by weight methyl oleate and 2 to 3 parts by weight triisopropanolamine.

12. A composition comprising a dyebath, padding liquor or printing paste which contains a disperse dye and to which has been added an aqueous emulsion according to claim 1 in an amount sufficient to provide a dyeing assistant-effective amount of compound of formula III.

13. A composition comprising a dyebath, padding liquor or printing paste which contains a disperse dye and to which has been added an aqueous emulsion according to claim 7 in an amount sufficient to provide a dyeing assistant-effective amount of compound of formula III.

14. A composition according to claim 13 wherein, in a dyebath, the amount of compound of formula III is 0.5 to 30 g/l and, in a padding liquor or printing paste, the amount of compound of formula III is 0.5 to 3 times the amount of disperse dye.

15. A composition according to claim 13 wherein the compound of formula III is selected from the group consisting of ethylene glycol dibenzoate, 1,2- and 1,3-propylene glycol dibenzoates, diethylene glycol dibenzoate, dipropylene glycol dibenzoate and mixtures thereof.

16. A composition according to claim 14 wherein the compound of formula III is selectsd from the group consisting of ethylene glycol dibenzoate, 1,2- and 1,3-propylene glycol dibenzoates, diethylene glycol dibenzoate, dipropylene glycol dibenzoate and mixtures thereof.

17. A method of dyeing or printing a textile substrate which comprises treating the substrate with a composition according to claim 12.

18. A method of dyeing or printing a textile substrate which comprises treating the substrate with a composition according to claim 13.

19. A method of dyeing or printing a textile substrate which comprises treating the substrate with a composition according to claim 16.

20. A method according to claim 19 which comprises the rapid dyeing of polyester.

* * * * *